US010036403B2

(12) United States Patent
Mornan et al.

(10) Patent No.: US 10,036,403 B2
(45) Date of Patent: Jul. 31, 2018

(54) VARIABLE VOLUME INDUCTION NOZZLE

(71) Applicants: Brian J. Mornan, Basking Ridge, NJ (US); Frank J. Beitz, Flemington, NJ (US); Nicholas J. Almerini, North Haledon, NJ (US)

(72) Inventors: Brian J. Mornan, Basking Ridge, NJ (US); Frank J. Beitz, Flemington, NJ (US); Nicholas J. Almerini, North Haledon, NJ (US)

(73) Assignee: Dyna-Tech Sales Corporation, Branchburg, NJ (US)

( * ) Notice: Subject to any disclaimer, the term of this patent is extended or adjusted under 35 U.S.C. 154(b) by 1176 days.

(21) Appl. No.: 14/209,154

(22) Filed: Mar. 13, 2014

(65) Prior Publication Data

US 2014/0286767 A1 Sep. 25, 2014

Related U.S. Application Data

(60) Provisional application No. 61/803,520, filed on Mar. 20, 2013.

(51) Int. Cl.

| | |
|---|---|
| ***F23L 17/02*** | (2006.01) |
| ***F04D 29/54*** | (2006.01) |
| ***F04F 5/46*** | (2006.01) |

(52) U.S. Cl.

CPC ..... *F04D 29/541* (2013.01); *F04F 5/461* (2013.01)

(58) Field of Classification Search

CPC ... F23L 17/02; E04F 17/04; F24F 7/00; F25F 7/00; F23J 11/00

USPC ..... 454/8, 16, 17, 340, 36, 39, 343, 1, 284, 454/18, 33

See application file for complete search history.

(56) References Cited

U.S. PATENT DOCUMENTS

| | | | | | |
|---|---|---|---|---|---|
| 2,188,564 | A | * | 1/1940 | Berg | F23L 17/02 454/39 |
| 2,483,922 | A | * | 10/1949 | Messer | F23L 17/02 454/12 |
| 2,626,557 | A | * | 1/1953 | Hersch | F23L 17/02 454/33 |
| 3,010,692 | A | * | 11/1961 | Jentoft | F16K 7/10 251/61.1 |
| 3,525,474 | A | * | 8/1970 | Mills | F02C 7/057 15/409 |
| 3,528,614 | A | * | 9/1970 | Honmann | F24F 13/26 239/419.5 |
| 3,719,032 | A | * | 3/1973 | Cash | B01D 47/10 110/148 |

(Continued)

FOREIGN PATENT DOCUMENTS

WO WO2009091477 A1 7/2009

*Primary Examiner* — Steven B McAllister
*Assistant Examiner* — Samantha Probst
(74) *Attorney, Agent, or Firm* — Thomas J. Germinario

(57) ABSTRACT

A variable volume induction nozzle is designed for use with a variable speed fan, where fan speed is adjusted in response to variable exhaust gas flow volume in order to conserve energy. In order to maintain a minimum exhaust discharge velocity to ensure adequate plume height, an axially-extendable, upwardly tapered flow-impinging pod within the nozzle creates a variable annular nozzle outlet opening. As opposed to a circumferentially-constricted outlet opening, the variable annular outlet produces a uniform discharge velocity profile conducive to the induction of ambient air through a windband.

15 Claims, 8 Drawing Sheets

(56) References Cited

U.S. PATENT DOCUMENTS 4,344,370 A * 8/1982 Smith ..... F23J 13/025 110/162
4,422,524 A * 12/1983 Osborn ..... F02K 1/1207 181/215
4,806,076 A * 2/1989 Andrews ..... F04D 29/4253 415/220
5,439,349 A * 8/1995 Kupferberg ..... F04D 29/4246 415/212.1
5,938,527 A * 8/1999 Oshima ..... F24F 1/01 454/303
6,112,850 A * 9/2000 Secrest ..... F04D 29/663 181/224
6,431,974 B1 * 8/2002 Tetley ..... F23L 17/005 454/16
6,509,081 B1 * 1/2003 Diamond ..... B32B 3/12 428/116
6,676,503 B2 * 1/2004 Hill ..... F23L 17/005 454/17
6,890,252 B2 5/2005 Liu
7,241,214 B2 * 7/2007 Sixsmith ..... F04D 29/441 454/17
7,547,249 B2 * 6/2009 Seliger ..... B08B 15/002 110/162
8,974,272 B2 * 3/2015 Mornan ..... F24F 7/025 239/419.5
9,233,386 B2 * 1/2016 Mornan ..... F23L 17/005
9,371,836 B2 * 6/2016 Mornan ..... F04D 29/542
2005/0170767 A1 * 8/2005 Enzenroth ..... B08B 15/002 454/36
2006/0179815 A1 * 8/2006 Means ..... F02K 1/825 60/39.5
2007/0298700 A1 * 12/2007 Datta ..... E04F 17/02 454/1
2011/0053488 A1 * 3/2011 Gans ..... B08B 15/002 454/343
2012/0322358 A1 12/2012 Wendorski et al.

* cited by examiner

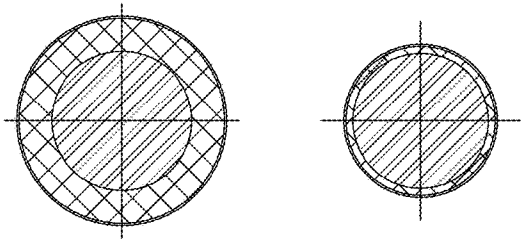
FIG. 5C
FIG. 5D
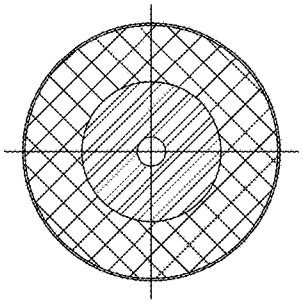
FIG. 5B
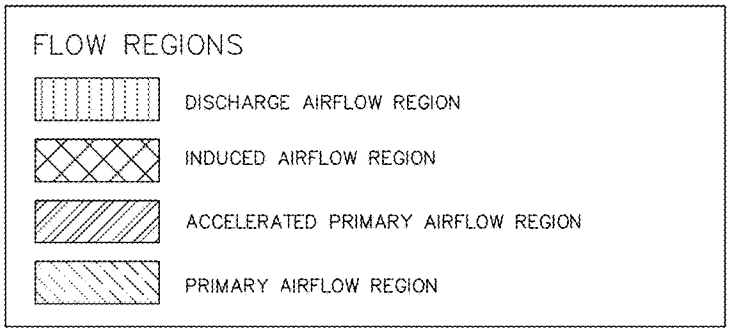
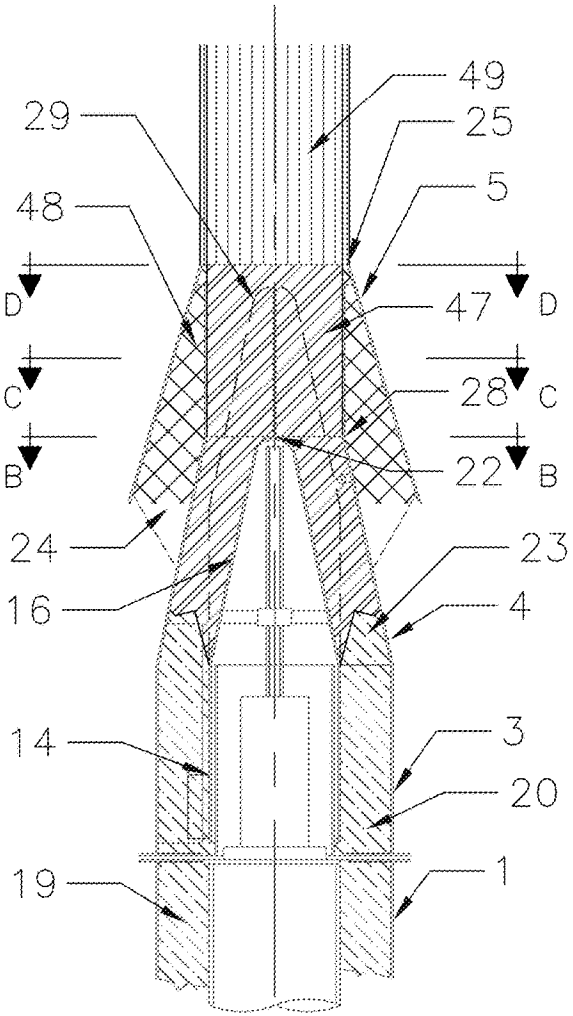
Fig—5A

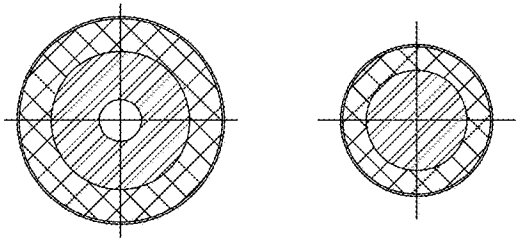
FIG. 6C
FIG. 6D
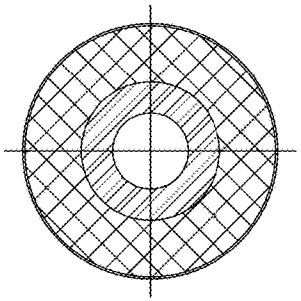
FIG. 6B
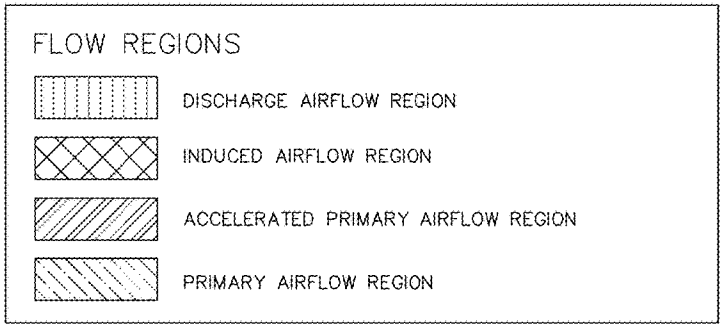
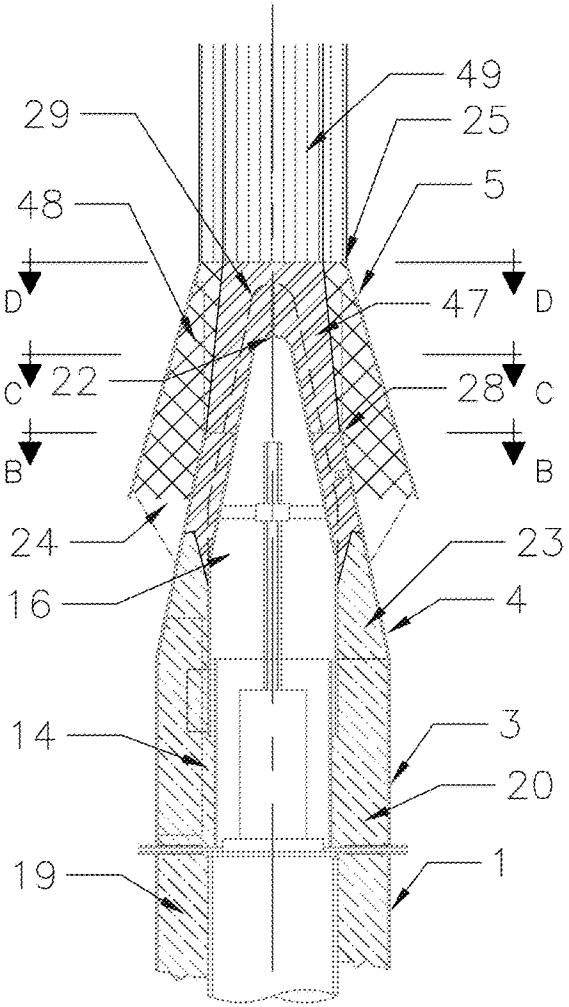
Fig—6A

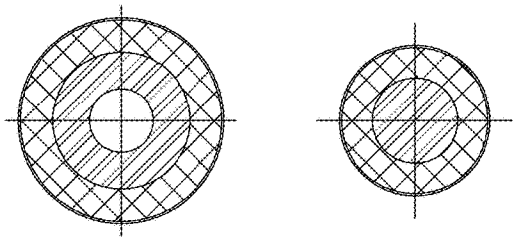
FIG. 7C
FIG. 7D
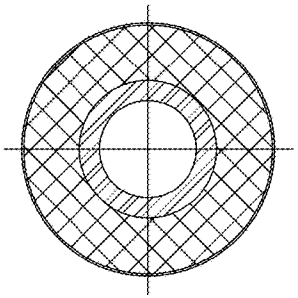
FIG. 7B
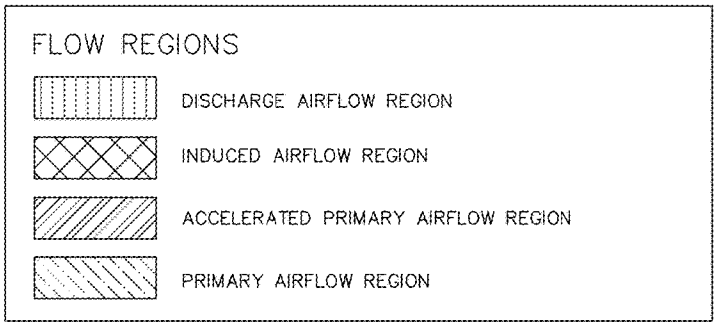
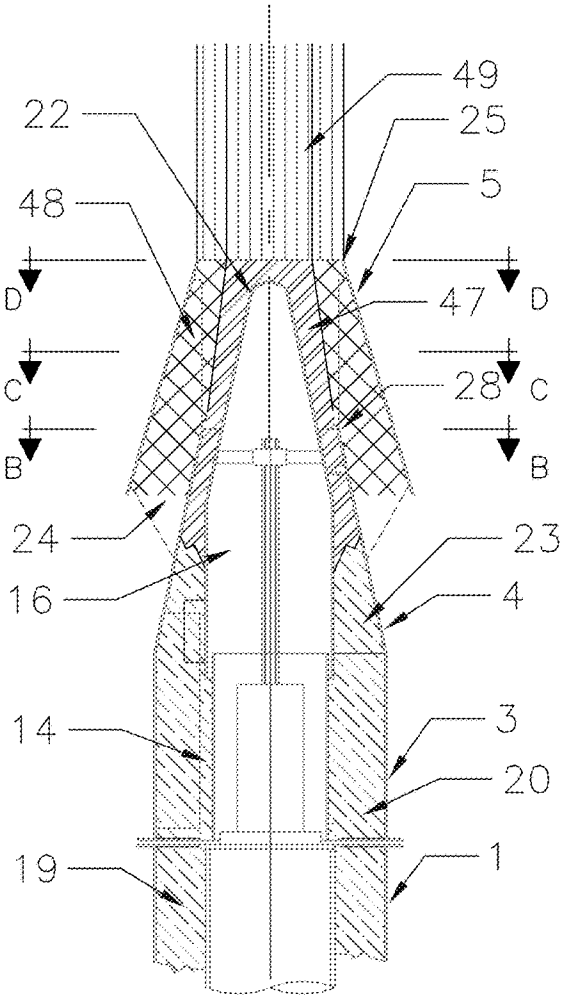
Fig-7A

VARIABLE VOLUME INDUCTION NOZZLE

REFERENCE TO RELATED APPLICATION

This application claims the benefit of the filing date of U.S. provisional Patent Application 61/803,520, filed Mar. 20, 2013, and it also relates to U.S. non-provisional patent application Ser. No. 13/067,269, filed May 20, 2011, the disclosures of both of which are incorporated herein by reference.

BACKGROUND OF THE INVENTION

The present invention relates to the field of exhaust air systems for buildings and/or other enclosed areas, and more particularly, to exhaust discharge nozzles configured to be attached to the outlets of exhaust fans, exhaust ducts and/or stacks, and similar exhaust type equipment/devices and are specifically designed to be installed in the outdoor ambient.

Many commercial and industrial processes exist which introduce hazardous and/or noxious chemicals into the building exhaust. These chemicals originate from a host of commercial/industrial processes within critical environments such as research laboratories, chemical storage facilities, generator housing rooms, thermal oxidizers, exhaust chemical scrubbers, etc. It is of paramount importance that the proper precautions are taken to ensure that the effluent is effectively managed 100% of the time. Specifically designed, purpose built exhaust systems are required to mitigate hazardous concentrations of processes chemicals. As governed by the ASHRAE 2011 HVAC Applications Handbook, a comprehensive flow model of the building must be executed to determine critical fluid flow patterns based on the unique geometry and wind flow patterns for the site. Consideration for the location of near-by air building fresh air intakes is a critical factor which must be accounted for so as to avoid possible effluent re-entrainment into the facility in unprocessed concentrations. In order to be effective, the critical exhaust provisions must be properly designed and must achieve continuous rated performance in the real world dynamic environment where the system is to operate. Failure to meet any of the above criteria would jeopardize the safety of those working in and around the proximity of the critical environment and/or residents of surrounding communities.

An effective solution, as standardized by ASHRAE, is to propel exhaust gases upward to a critical height above the building roofline where the atmospheric free stream can provide sufficient plume dilution, thus reducing the concentrations of hazardous chemicals to levels deemed safe. This critical height is termed the "effective stack height." In its simplest form, the effective stack height is the height at which a theoretical centerline of the building exhaust plume becomes completely horizontal due to the impact of the specified horizontal cross wind velocity. The effective stack height, $h_{se}$ (ft), can be calculated from the American Society of Heating, Refrigerating and Air Conditioning Engineers (ASHRAE) HVAC Applications Handbook as:

$$h_{se}=h_s+h_r-h_d$$

Where:

$h_s$ is the physical exhaust system height (ft)

$h_r$ is the plume rise (ft)

$h_d$ is the amount of stack wake downwash in (ft)

The plume rise component, $h_r$, is the distance the exhaust plume will be propelled above the terminal discharge point of the physical equipment. Plume rise for momentum driven flow is calculated based on the recommendations of the ASHRAE. From as early as 1999 through 2010 the ASHRAE HVAC Handbook has stipulated the use of a special case of the Brigg's Equations to determine plume rise $h_r$, which is defined as:

$$h_r=3.0d_e(V_e/U_H)$$

$d_e$ is the effective (hydraulic) diameter (ft) at the terminal discharge point of the system computed from: $d_e=(4A_e/\pi)\hat{}(1/2)$, where $A_e$ is the cross-sectional area of the discharge opening $V_e$ is the equipment exit velocity (ft/min) at cross wind velocity $U_H$ is the cross wind velocity (ft/min) at the building roofline This adaptation of the Briggs Equation is a function of dynamic variables. Equipment performance data must be acquired using dynamic testing parameters. Specifically, the equipment exit velocity, $V_e$, must be measured with the specified design cross wind, $U_H$, applied to the system. Moreover, it is a necessary condition that the effective diameter, $d_e$, be determined for the location where the equipment exit velocity, $V_e$, was measured. It is recommended that this location be final discharge point (i.e. terminal location) of the exhaust system to the atmosphere. For this form of the Briggs equation for plume rise to be applicable, the discharge velocity profile at the system discharge must be characterized as uniform. A uniform velocity profile is defined as having minimal velocity gradients in the transverse plane of system discharge.

The initial adaptation and application of the Briggs equation for plume rise did not effectively capture many critical site specific parameters, and the accepted method for calculating plume rise has been redefined in the ASHRAE 2011 HVAC Applications handbook using the Briggs equation for the vertical jet momentum of the exhaust versus downwind distance as:

$$h_r=\min\{\beta h_x, \beta h_f\}$$

$\beta$ is the stack capping factor, 1.0 without cap as in the present invention The plume rise verses downwind distance $h_x$ in (ft) is obtained from:

$$h_x=[(3F_m x)/(\beta_j^2 U_H^2)]\hat{}(1/3)$$

$F_m$ is the momentum flux ($ft^4/s^2$) and is calculated as $F_m=V_e^2(d_e^2/4)$ $\beta_j$ is the jet entrainment coefficient computed as $\beta_j=1/3+(U_H/V_e)$ x is the downwind distance The final plume rise $h_f$ in (ft) is determined from:

$$h_f=\{0.9[F_m(U_H/U^*)]\hat{}(1/2)\}/(U_H\beta_j)$$

$U_H/U^*$ is the he logarithmic wind profile computed as $U_H/U^*=2.5\ \ln(H/z_0)$ H is the building height above ground level (ft)

U* is the friction velocity (ft)

$z_0$ is the surface roughness length (ft) which can be obtained from the Atmospheric Boundary Layer Parameters Table in Chapter 45 of the ASHRAE 2011 HVAC Design Handbook.

The possibility of stack wake downwash, $h_d$, is an essential component to evaluate when computing the effective stack height of an exhaust system. Stack wake downwash occurs where low velocity exhaust streams are pulled downward by negative pressures immediately downstream of the exhaust system discharge. The amount of stack wake downwash in (ft) can be obtained from $h_d = d_e[3.0 - \beta(V_e/U_H)]$ As specified in the ASHRAE 2011 standard, the cross wind velocity at the building roofline $U_H$, as applied to all equations which require this parameter, is the maximum design wind speed at the building roof height at which air intake contamination must be avoided. As stated by ASHRAE, this maximum design speed must be at least as large as the hourly wind speed exceeded 1% of the time. Chapter 14 of the 2009 ASHRAE Fundamentals Handbook lists this value for many cities.

Upon examination of the equation for effective stack height it becomes evident that the most critical parameters affecting a system's ability to achieve this specification are discharge geometry ($d_e$), discharge velocity ($V_e$), and the design wind speed ($U_H$) where the system is to operate. Furthermore, the American National Standards Institute/American Industrial Hygiene Association ANSI/AIHA Z9.5 2012 Laboratory Ventilation standard mandates a minimum discharge velocity of 3000 ft/min be constantly maintained in order to be in compliance. Standard Z9.5 2012 also specifies that the physical exhaust system height, $h_s$, be a minimum of 10 ft. above adjacent roof lines and air intakes and in a vertical up direction.

It should be noted that standard industry testing methods, at the present time do not incorporate cross winds into the testing protocol. The Air Movement and Control Association (AMCA) has developed AMCA Standard 260-07 Laboratory Methods of Testing Induced Flow Fans for Rating and is generally accepted as the industry standard. However, while this test does certify discharge flow volume of an induction exhaust system, it does not include dynamic testing with the influence of a cross wind. Therefore, using outlet flow data to calculate system exit velocities measured according to AMCA standard 260-07 can lead to erroneous discharge velocity ratings. Furthermore, if static system exit velocities (i.e. no cross wind present during measurement) are used in the special case Briggs Equation, which is a function of dynamic variables only, to determine plume rise, the prediction of performance will be physically incorrect. Plume rise (i.e. the quotient) determined in this manner would always be mathematically undefined (i.e. infinite asymptote) due to the 0 ft/min cross wind velocity devisor; which is an impossible physical phenomena to achieve. However, if the AMCA standard 260-07 were modified to incorporate cross wind, then the Briggs equations would be a mathematically valid method of calculating plume rise, provided that the velocity profile at the discharge was uniform. Additionally, an advanced engineering approach is to use computational fluid dynamics (CFD) software to calculate system performance; the AMCA 260 test can be simulated with the cross wind component included to develop real world performance data. The Briggs equation is valid for calculating plume rise using the CFD data; however this only applies to systems with a uniform discharge profile. Additionally, the most current methodology of calculating plume rise as defined by ASHRAE should always be used.

Complying with the necessary laws, codes, standards and recommendations is becoming increasingly challenging, as recent advancements have led to an increasing number of variable volume laboratory designs and installations. One of the most significant benefits of variable volume systems is the ability to turn down the exhaust air volume in response to usage requirements. This reduction is exhaust flow results in a significant energy savings. However, reducing the exhaust flow volume using conventional/existing technology has historically made achieving the required effective stack height and minimum exhaust discharge velocities challenging due to the accompanying reduction in discharge velocity.

The present invention is designed to instantaneously modulate and control discharge geometry and discharge velocity in response to varying primary exhaust air flows, dilution requirements, and roof line wind speeds, so that the mandated effective stack height is continuously achieved. The device is designed with a variable discharge diameter to gradually accelerate the exhaust effluent to a sufficiently high velocity. An adjustable impingement pod, which runs the full length of the nozzle section, provides a mechanism to gradually reduce the nozzle's cross-sectional area, thereby producing a uniform acceleration of the primary exhaust stream. The uniform acceleration has the specific benefit of minimizing high velocity gradients within the nozzle which contribute to exhaust stream energy loss. A unique controls strategy is employed which provides on demand response to varying primary flow conditions, dilution and changing roofline wind speeds. Bypass air dampers, system discharge area and motor speed adjust in a coordinated effort to meet operational exhaust requirements as outlined above. Thus, the present invention is an energy efficient alternative to conventional technology.

The application of discharge nozzles at the exit point of exhaust systems enhances the performance capability with the specific intent of maximizing the exhaust/effluent dispersion into the upper atmosphere of the hazardous contaminated air and/or effluent gases and vapors from buildings, rooms, and other enclosed spaces. Discharge nozzles able to provide a superior alternative to conventional tall exhaust stacks which are costly to construct and are visually unattractive by today's standards. Properly designed nozzles are capable of propelling high velocity plumes of exhaust gases to heights sufficient to prevent stack wake downwash and disperse the effluent over a large upper atmospheric area so as to avoid exhaust contaminant re-entrainment into building ventilation intake zones.

A further development of the variable-volume exhaust nozzle design is the type nozzle that employs the Venturi effect to draw additional ambient air into the primary effluent stream. The venturi type nozzle can further be described as an aspirating, or induction type, as related to conventional technological description for this type nozzle. The additional induced air volume dilutes the primary exhaust gases at/near the nozzle as the combined mixed air volumes are released into the atmosphere. Also, with this exhaust-air mixture volume increase, the discharged gas is expelled at a higher velocity, achieving a greater plume height. The underlying effect of greater volume at greater discharge velocity is an increased effluent momentum, which assists with the effluent disbursement into the atmosphere.

The features and functions of induction nozzles are described in greater detail in U.S. patent application Ser. No. 13/067,269, the disclosure of which is incorporated herein by reference.

High plume lift is particularly critical with regard to exhaust gases from potentially contaminated sources, such as laboratories and other facilities in which chemical processes produce noxious fumes. To insure that potentially contaminated exhaust reaches a minimum altitude to avoid downwash, many environmental and building code standards specify a minimum discharge velocity from an exhaust nozzle. For example, ANSI Z9.5 2012 currently requires a minimum discharge velocity of 3000 feet per minute (FPM) at the outlet of a lab exhaust nozzle.

Maintaining a minimum exhaust nozzle discharge velocity can be problematic when there is a high turndown ratio in the critical space, meaning the primary exhaust flow rate is highly variable. This is typically the case in laboratories, for example, where some of the fume hoods may be inactive at any given time, so that the primary exhaust rate is often below the design value for the exhaust fan. Since lowering the fan speed can reduce the exhaust outlet velocity below the 3000 FPM minimum, the conventional approach in the past has been to maintain a constant fan speed while opening bypass air dampers to draw in ambient air.

One existing approach to variable primary flows is to select fans to perform at the maximum exhaust flow condition of the critical space. When the flow requirements of the critical space are reduced, a bypass damper is opened to incorporate unconditioned outside air into the fan to make up the difference in flow volume. While this approach is functional, the practice of running exhaust fans continuously at speeds designed to handle the maximum design exhaust flow condition is wasteful in terms of energy consumption. To conserve energy, it's preferable to use variable speed fans in which the fan speed decreases as the primary exhaust flow rate decreases. In order to maintain a minimum discharge velocity through an exhaust nozzle, the cross-sectional outlet area of the nozzle can be varied by mechanical means, such as dampers.

Mechanical variation of the nozzle outlet area has the disadvantage of causing non-uniform exhaust flow gradients at the approach to the constricted nozzle opening. In other words, the exhaust flow velocity does not increase uniformly with respect to distance travelled. This creates the opportunity for turbulent flow pattern to develop and produces non-uniform pressure and velocity profiles at the constricted nozzle outlet. As a result, an uncorrected Briggs equation for calculating plume rise would not apply to such a device, and performance would not be readily predictable.

As discussed in U.S. patent application Ser. No. 13/067,269, the use of a wind band at the nozzle outlet provides the advantages of shielding the exhaust discharge from crosswinds, which reduce plume height, as well as inducing ambient air flow through the windband, thereby increasing discharge flow volume and velocity. But effective induction through the windband requires uniform pressure and velocity profiles at the nozzle outlet, which cannot be achieved if the nozzle outlet is mechanically constricted.

Instead of mechanically constricting the nozzle outlet area in response to reduced fan speed, the present invention uses an axially-extendable, upwardly tapered flow-impinging pod within the nozzle to create a variable annular nozzle outlet opening. As the impinger pod is extended upward through the nozzle opening, the annular space around the pod narrows gradually and uniformly in the direction of the nozzle outlet, thereby enabling a linear velocity gradient and producing a uniform discharge velocity profile conducive to optimal induction through the windband, as well as maximizing the integrity of the exhaust plume

SUMMARY OF THE INVENTION

The present invention is an induction nozzle for vertical connection to an exhaust gas outlet of a variable-speed fan for new and retrofit applications. The nozzle comprises a nozzle wall which can be tubular or frusto-conical, but preferably tubular tapering upward to frusto-conical, as shown in FIG. 1. The nozzle has an exhaust inlet, connected to the fan's exhaust gas outlet, and a discharge outlet, through which exhaust gas is discharged from the nozzle.

Within the nozzle is a variable annular effluent passage, through which exhaust gas flows from the fan through the exhaust inlet to the discharge outlet. The annular effluent passage surrounds an upwardly tapered impinger pod, which is axially disposed within the effluent passage. The impinger pod has a cylindrically tubular lower section concentrically surrounding a tubular guide sleeve, along which the impinger pod slides up, i.e., in the direction of the discharge outlet, or down, i.e., in the direction of the exhaust inlet, in response to corresponding movements of a linear actuator located within the guide sleeve, as depicted in FIGS. 2-4.

The impinger pod has a substantially conical upper section terminating in a rounded pod tip. The linear actuator moves the impinger pod from a fully open position, in which the pod tip is aligned with the discharge outlet, as shown in FIG. 2, to a fully closed position, in which the conical upper section of the pod projects through the discharge outlet as shown in FIG. 4. The linear actuator can also move the impinger pod into any intermediate position between the fully open position and the fully closed position, as illustrated in FIG. 3.

The nozzle, fan, and mixing plenum function as a smart fan assembly, which is controlled by a central processing unit (master controller). The system is designed to respond to two variable flow conditions; wind speed and primary exhaust flow. All inputs are received in real time and then processed in accordance with the control logic to maintain optimal system performance. Optimal performance is defined by maintaining the effective stack height and dilution requirements with the lowest energy consumption. The master controller continuously monitors input signals, sensing fans in operation (for multiple fan systems), primary exhaust flow, duct static pressure, bypass damper position, isolation damper position, motor speed, nozzle velocity, pod position, and roof line wind speed. The master controller calculates the optimal fan sequencing for multiple fan systems, position for motor speed, ambient bypass damper position and impinger pod position. This unique ability provides safe ventilation of variable volume exhaust systems for critical environments in a variable wind speed condition. The master controllers function is to provide dynamic intelligent logic for full and part load operation to select the optimum strategy for indexing multiple points of control and to intelligently correct the strategy for optimal system performance versus lowest cost of energy—essentially optimizing plume performance without compromising safety. The controller will include the ability to provide real time analysis and reporting of actual cost to operate versus a non-optimized system; the system will include the option for dashboard information management and display. This system will also include real time web-based interface, connectivity to building control system, and internet connectivity for auto alarming and remote diagnostics.

When exhausting critical environments it is good engineering practice, and many times mandated, to incorporate redundancy into the design. This redundancy typically includes multiple fans installed on a common plenum with a portion operating and at least one fan on standby for emergency situations. Fan sequencing is controlled by the central processing unit and ensures equal use of all fans. Additionally, fan sequencing provides an opportunity to manage reduced exhaust flow conditions and ensure minimal energy consumption while meeting exhaust requirements. An added benefit of the control logic is to provide wear cycling, whereby redundant fans are cycled into operation, thereby ensuring that all fans have equal run time.

The bypass damper position is controlled to also ensure that dilution requirements, if any, are being satisfied and that required system performance is being achieved.

Wind speed at the building roofline is monitored by a velocity sensor (e.g. anemometer). Under the ASHRAE 2011 standard, any system is designed to operate at the wind speeds realized 1% of the time for the specific site where the system is installed. .The present invention can therefore reduce energy consumption 99% of the time by modulating adjustment points such as bypass damper position, impingement pod position, and motor speed in response to varying system conditions such as wind speed and primary exhaust flow, while maintaining required performance.

Motor speed is typically controlled by a variable frequency drive. A variable frequency drive provides a mechanism for the central processing unit to sense motor speed and determine if increasing or decreasing motor speed will maintain performance while reducing energy consumption. The speed of the motor and brake horsepower consumption are related according to the following expression:

$$BHP_2=[(RPM_2/RPM_1)^3]BHP_1$$

BHP is the brake horsepower consumption of the system

RPM is the speed of the fan

Subscripts 1 and 2 designate existing and new conditions respectively

Accordingly, there is a significant energy savings benefit to reducing the speed of the fan if conditions permit. The central processing unit functions to determine how to optimally reduce motor speed.

A velocity sensor-processor located within the nozzle near the discharge outlet measures discharge velocity of the exhaust stream; this information will control the impinger pod to most optimal position.

Duct static pressure is measured to control the fan assembly to maintain exhaust stability in a variable flow system.

The logic to control the fan assembly is designed to be application specific; each system will have variable design parameters, such as, number of fans, wind speed, exhaust flow turndown, effective stack height and dilution dispersion. A schematic diagram of an exemplary fan assembly control system is illustrated in FIG. 8.

The induction nozzle of the present invention also comprises a frusto-conical windband, which is attached in converging annular spaced relation to the exterior of the nozzle wall by multiple mounting brackets and concentrically surrounds the discharge outlet of the nozzle as depicted in FIGS. 1-4. The interior of the windband defines an upward-tapering frusto-conical exhaust passage, extending from a lower inlet opening to an upper outlet opening. The nozzle discharge outlet projects upward through the windband inlet opening and thereby defines an annular induction flow passage between a top section of the nozzle wall and a bottom section of the windband.

The high velocity discharge of exhaust gas from the nozzle discharge outlet induces an ambient air inflow through the annular induction flow passage and upward through the exhaust passage of the windband. Based on uniform exhaust pressure and velocity profiles at the nozzle discharge outlet, the induced ambient air inflow merges non-turbulently with the exhaust gas from the nozzle discharge outlet to produce a combined exhaust plume with increased volume, momentum and lift.

As the discharging primary air volume is accelerated in the nozzle/windband section, a vena contracta can be observed; the vena contracta is the point in the discharging air stream where the hydraulic diameter is the least and the velocity is at its maximum. This effect is observed slightly downstream of the nozzle discharge and can be characterized by a contraction coefficient, which is defined as the ratio of the area of the exhaust stream (i.e. jet) and the area of the nozzle discharge (i.e. orifice). The position of the tip of the impingement pod has an intrinsic influence on the vena contracta characteristics. The exhausting air volume will tend to separate from the tip of the impingement pod and converge at a downstream distance which is dependent on pod position. When the flow converges, the velocity is at a maximum and the vena contracta is evident. The maximized velocity at this point serves to enhance the venturi effect and further improve the induction capacity of the system. This effect is unique to the present invention and serves to optimize plume characteristics and system performance in all pod positions.

The requisite uniform exhaust discharge pressure and velocity profiles are generated by the variable annular nozzle outlet opening defined by the adjustable position of the impinger pod. As shown in FIGS. 5A-D, 6A-D and 7A-D, the position of the pod in the fully open, intermediate and fully closed positions, respectively, produce a linear, uniform convergence of the annular exhaust discharge flow at points downstream of the induced annular ambient air inflow through the windband, thereby enabling the laminar merger of the exhaust flow with the induced ambient air.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

BRIEF DESCRIPTION OF THE DRAWINGS

FIG. 5A is the longitudinal cross-section view of FIG. 2, corresponding to the fully open pod position, with cross-hatching designating four airflow regions;

FIG. 5B is an axial cross-section view of the exemplary nozzle, taken along line B-B in FIG. 5A, with cross-hatching designating two airflow regions;

FIG. 5C is an axial cross-section view of the exemplary nozzle, taken along line C-C in FIG. 5A, with cross-hatching designating two airflow regions;

FIG. 5D is an axial cross-section view of the exemplary nozzle, taken along line D-D in FIG. 5A, with cross-hatching designating two airflow regions;

FIG. 6A is the longitudinal cross-section view of FIG. 3, corresponding to the intermediate pod position, with cross-hatching designating four airflow regions;

FIG. 6B is an axial cross-section view of the exemplary nozzle, taken along line B-B in FIG. 6A, with cross-hatching designating two airflow regions;

FIG. 6C is an axial cross-section view of the exemplary nozzle, taken along line C-C in FIG. 6A, with cross-hatching designating two airflow regions;

FIG. 6D is an axial cross-section view of the exemplary nozzle, taken along line D-D in FIG. 6A, with cross-hatching designating two airflow regions;

FIG. 7A is the longitudinal cross-section view of FIG. 4, corresponding to the fully closed pod position, with cross-hatching designating four airflow regions;

FIG. 7B is an axial cross-section view of the exemplary nozzle, taken along line B-B in FIG. 7A, with cross-hatching designating two airflow regions;

FIG. 7C is an axial cross-section view of the exemplary nozzle, taken along line C-C in FIG. 7A, with cross-hatching designating two airflow regions;

FIG. 7D is an axial cross-section view of the exemplary nozzle, taken along line D-D in FIG. 7A, with cross-hatching designating two airflow regions.

DETAILED DESCRIPTION OF THE PREFERRED EMBODIMENT

Figure 1:
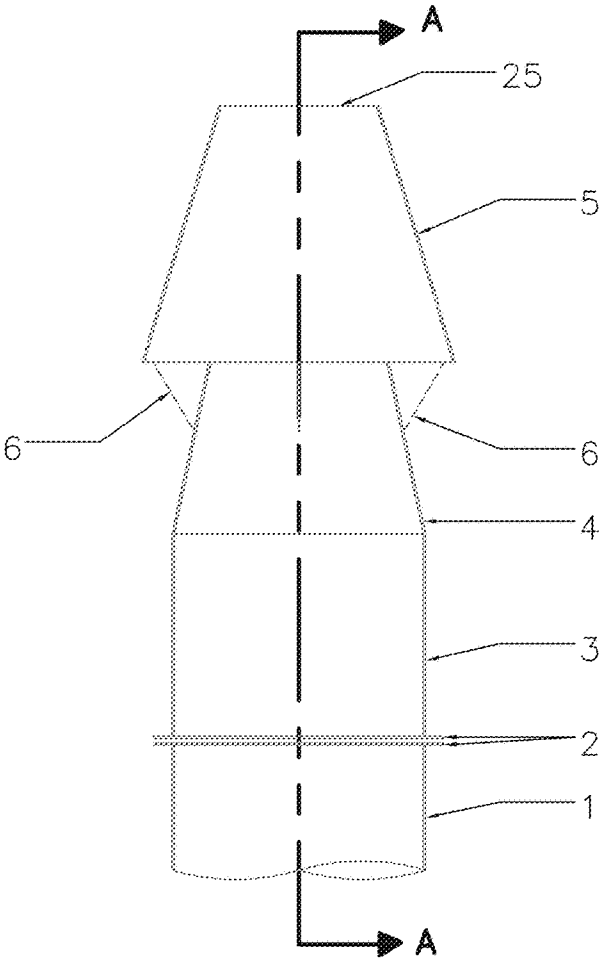
FIG. 1 is a side profile exterior view of an exemplary variable volume induction nozzle in accordance with the preferred embodiment of the present invention.

Referring to FIG. 1, the preferred embodiment of the present invention comprises a variable volume induction nozzle, which is vertically connected to the primary exhaust gas outlet 1 of a variable speed fan by way of a flange at the nozzle exhaust inlet 2. The nozzle wall comprises a tubular lower section 3 and a tapered frusto-conical upper section 4. The nozzle further comprises a frusto-conical windband 5, which is attached to the upper section 4 of the nozzle wall by multiple mounting brackets 6.

Figure 2:
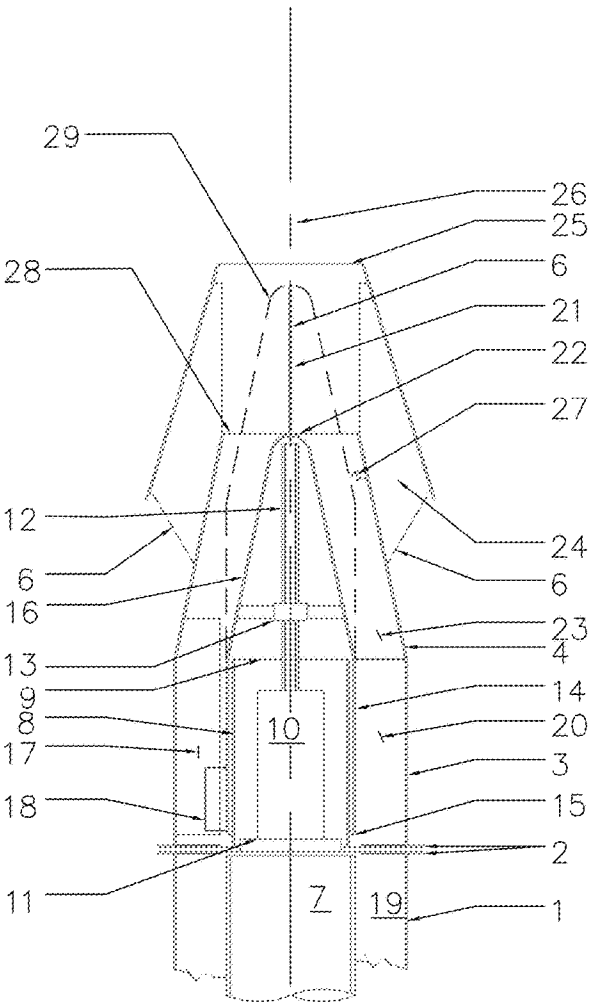
FIG. 2 is a longitudinal cross-section view of the exemplary variable volume induction nozzle of FIG. 1, taken along line A-A, showing the impinger pod in the fully open position.
Figure 3:
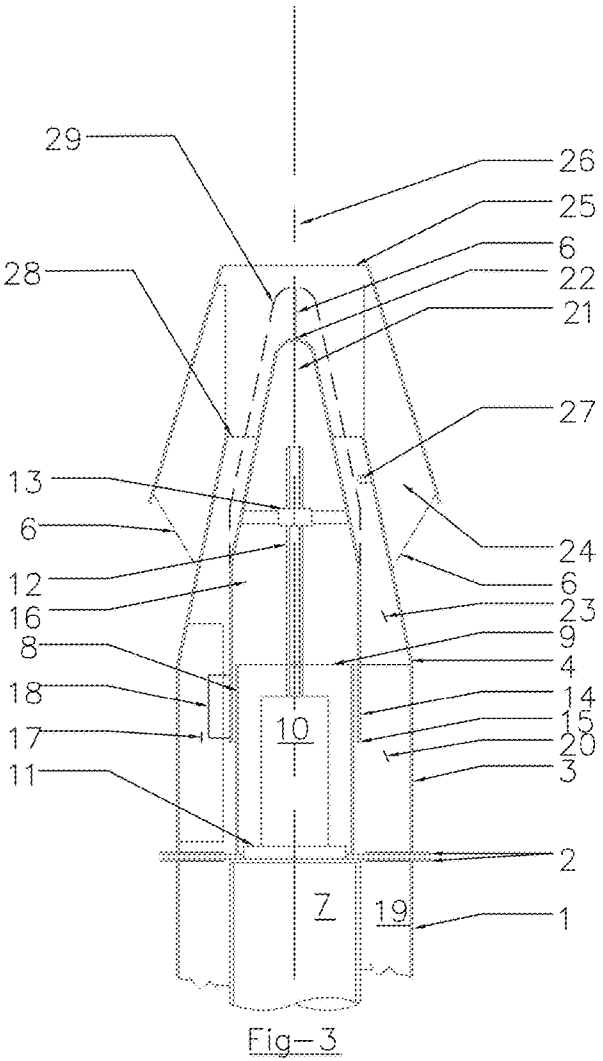
FIG. 3 is a longitudinal cross-section view of the exemplary variable volume induction nozzle of FIG. 1, taken along line A-A, showing the impinger pod in an intermediate position.
Figure 4:
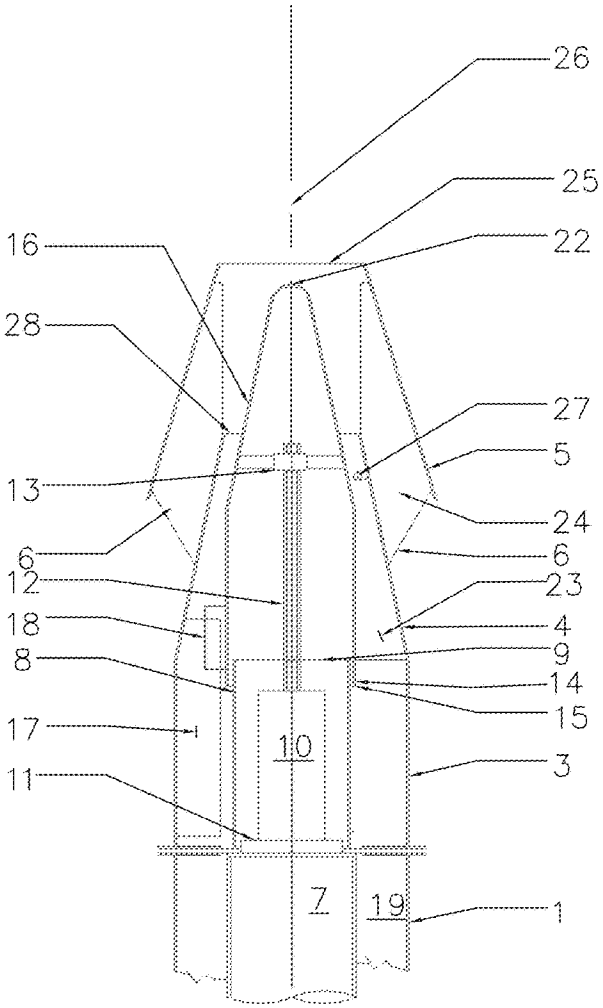
FIG. 4 is a longitudinal cross-section view of the exemplary variable volume induction nozzle of FIG. 1, taken along line A-A, showing the impinger pod in the fully closed position.

FIGS. 2-4 depict cross-section views of the variable volume induction nozzle. FIG. 2 depicts the nozzle in the fully open position, corresponding to a condition of maximum primary exhaust flow, with the fan operating at maximum speed. FIG. 4 depicts the nozzle in the fully closed position, corresponding to a condition of minimum primary effluent flow, with the fan operating at minimum speed. FIG. 3 depicts the nozzle in an intermediate position, with the fan operating between minimum and maximum speed.

Referring to FIGS. 2-4, the fan outlet 1 defines an annular exhaust gas passageway 19 surrounding the fan motor housing 7. The annular fan outlet exhaust gas passageway 19 fluidly communicates through the nozzle inlet 2 with a uniform annular lower effluent passage 20 in the nozzle's lower section 3. This lower effluent passage 20 is defined by an axially-disposed tubular pod lower section 14. A conically tapered pod upper section 16—the taper of which matches that of the upper section 4 of the nozzle wall—defines a converging annular upper effluent passage 23.

In the fully open position, as shown in FIG. 2, the rounded pod tip 22 is aligned with the nozzle's exhaust discharge outlet 28, such that the exhaust flow from the annular upper effluent passage 23 converges linearly at a first exhaust convergence point 21, downstream of the windband inlet opening 24, thereby inducing a laminar annular inflow of ambient air through the windband inlet opening 24. In the fully closed position, as shown in FIG. 4, the pod tip 22 projects through the nozzle's exhaust gas discharge outlet 28 and extends to a location below the windband outlet opening 25. In the closed position, the exhaust flow from the annular upper effluent passage 23 converges linearly at a second exhaust convergence point 26, downstream of the windband outlet opening 25, thereby inducing a laminar annular inflow of ambient air through the windband inlet opening 24.

Referring to FIGS. 2-4, the motion of the impinger pod between the open position and the closed position is controlled by a linear actuator 10 acting through an actuator screw 12 on a screw travel nut 13 connected to the pod's upper section 16. The pod's tubular lower section 14 moves up and down, in response to the linear actuator 10, along a conforming tubular guide sleeve 9, with its travel alignment controlled by a guide key 18 within a conjugate guide track 17.

Near the nozzle's discharge outlet 28, a velocity sensor-processor 27 is located, which takes periodic measurements of the discharge velocity of the exhaust gas, compares it with a velocity set point, and signals the linear actuator 10 to either lower the impinger pod to a more open position, if the measured discharge velocity is above the set point, or raise the pod to a more closed position, if the measured discharge velocity is below the set point.

As illustrated in FIGS. 5A-D, 6A-D and 7A-D, the converging annular upper effluent passage 23 generates a uniform accelerated primary airflow region 47, which maximizes the induced airflow 48 through the windband inlet opening 24 and generates a combined laminar discharge airflow 49 through the windband outlet opening 25.

Figure 8:
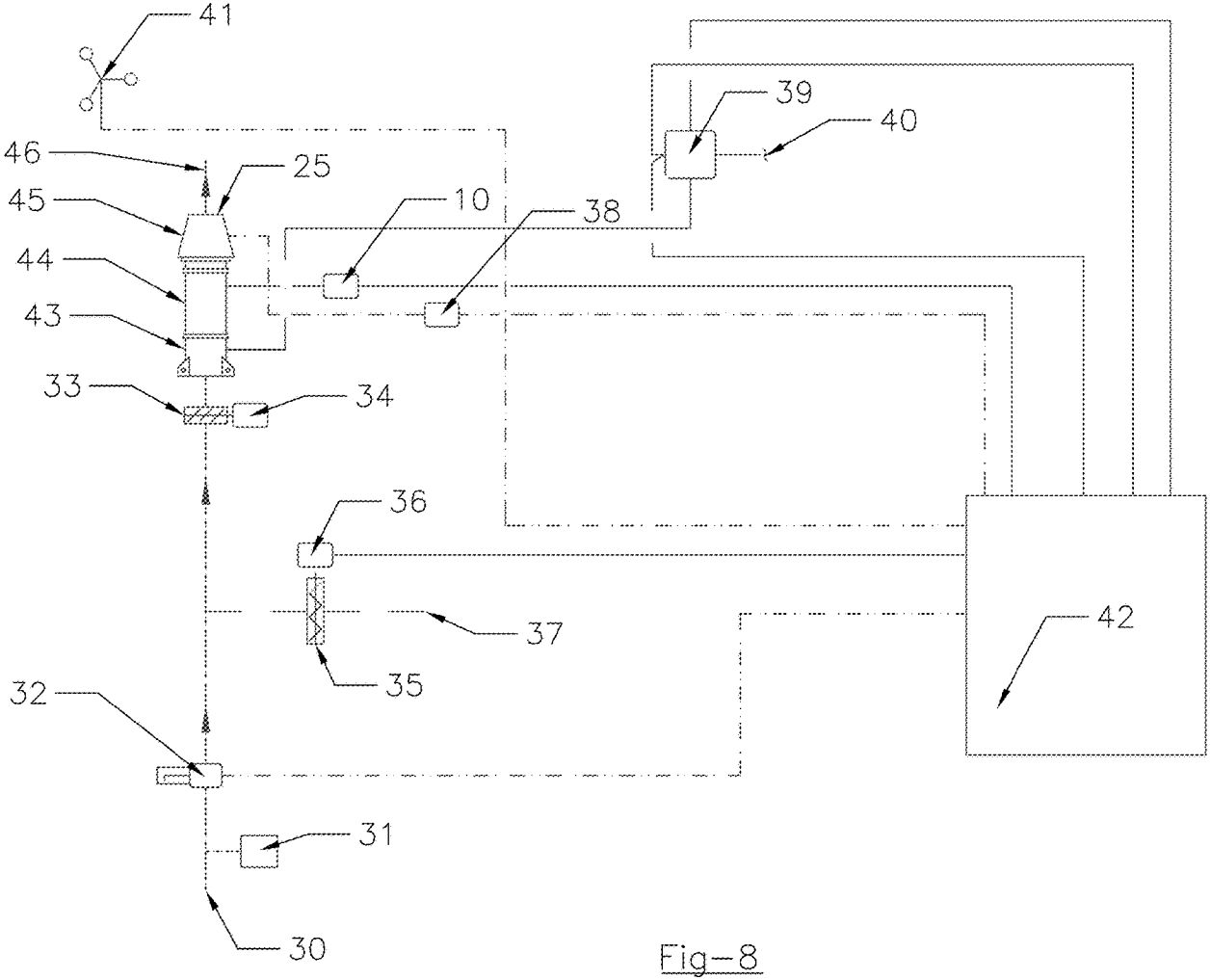
FIG. 8 is a schematic diagram depicting an exemplary control system for the preferred embodiment of the present invention.

FIG. 8 depicts exemplary control system for the variable volume induction nozzle 45 and associated fan assembly. The flow rate of the primary exhaust has 30 is monitored 31, along with the static pressure 32 of the exhaust gas upstream of the fan 44. Based on these readings, a master controller (CPU) 42 activates a bypass air actuator 36 to control the opening and closing of a bypass air damper 35, so that a greater volume of bypass air 37 is introduced when the primary exhaust flow rate 31 and/or static pressure 32 drop below designated design values.

The primary exhaust gas 30, augmented as needed by the bypass air 37, enters the fan plenum 43 through the fan's isolation damper 33, controlled by a spring-return actuator 34. From the fan 44, the augmented exhaust gas 30 37 flows through the nozzle 45, where its flow rate is accelerated to a degree determined by the position of the impinger pod, as controlled by the linear actuator 10.

The CPU 42 monitors flow velocity and/or velocity pressure 38 near the nozzle outlet 25 and uses such data to adjust fan speed through a variable frequency drive 39 (connected to an electric power source 40), as well as pod position through the linear actuator 10, to achieve a required plume rise based on a design discharge velocity 46. The CPU 42 calculates the design discharge velocity 46 using the Briggs Equation and the prevailing cross-wind velocity, as measured by an anemometer 41 at the building roofline.

Although the preferred embodiment of the present invention has been disclosed for illustrative purposes, those skilled in the art will appreciate that many additions, modifications and substitutions are possible, without departing from the scope and spirit of the present invention.

What is claimed is:

1. A variable volume induction nozzle for vertical connection to a fan outlet for an exhaust gas from a variable speed fan, the nozzle comprising:

a nozzle wall, defining a nozzle plenum, which has a central longitudinal axis constituting a plenum axis, wherein the nozzle wall comprises a lower wall section and an upper wall section, and and wherein the lower wall section terminates in a substantially circular nozzle exhaust inlet and the upper wall section terminates in a substantially circular nozzle discharge outlet, and wherein the nozzle exhaust inlet fluidly communicates with the fan outlet;

an impinger pod, which is axially extendably disposed at an adjustable pod position within the nozzle plenum, wherein the impinger pod comprises a pod axis, consisting of a central longitudinal axis of the impinger pod, and wherein the pod axis is aligned, at each adjustable pod position, with the plenum axis, and wherein the impinger pod defines within the nozzle plenum, in conjunction with the nozzle wall, a variable annular effluent passageway for the exhaust gas, and wherein the impinger pod comprises an inwardly and upwardly conically tapered upper pod section, which terminates in a convex pod tip, in order to induce a laminar inflow of ambient air through a windband, and a lower pod section, and wherein the effluent passageway comprises an upper affluent passageway and a lower effluent passageway;

wherein the impinger pod is vertically axially extendable, along the plenum axis, to a full pod extension, in which the pod tip maximally extends above the nozzle discharge outlet, and wherein the impinger pod is vertically axially retractable, along the plenum axis, to a full pod retraction, in which the pod tip does not extend above the nozzle discharge outlet or minimally extends above the nozzle discharge outlet, and wherein the impinger pod is vertically axially extendable and retractable to multiple intermediate pod positions, along the plenum axis, between the full pod extension and the full pod retraction; and wherein, when the impinger pod is at full pod retraction, the nozzle is in a fully open position, corresponding to a maximum flow of exhaust gas, with the fan operating at a maximum fan speed, and wherein, when the impinger pod is at full pod extension, the nozzle is in a fully closed position, corresponding to a minimum flow of exhaust gas, with the fan operating at a minimum fan speed, and wherein, when the impinger pod is at one of the intermediate pod positions, the nozzle is in an intermediate position, corresponding to an intermediate flow of exhaust gas, with the fan operating between the minimum fan speed and the maximum fan speed.

2. The nozzle of claim 1, wherein the nozzle wall has an upward wall taper, such that the nozzle wall tapers from the lower wall section to the upper wall section.

3. The nozzle of claim 2, wherein the lower wall section is tubular and the upper wall section is tapered frusto-conical.

4. The nozzle of claim 3, wherein the impinger pod has an upward pod taper, such that the impinger pod tapers from the lower pod section to the upper pod section.

5. The nozzle of claim 4, wherein the upward pod taper conforms to the upward wall taper.

6. The nozzle of claim 5, wherein the lower pod section is tubular, the upper pod section is substantially conical or frusto-conical, and the pod tip is rounded or hemispherical.

7. The nozzle of claim 6, wherein the upper effluent passageway has an annular convergence which is determined by the pod position, such that the annular convergence increases, and the upper effluent passageway narrows, as the impinger pod is adjusted from the full pod retraction to the full pod extension.

8. The nozzle of claim 7, wherein the pod position is adjustable by a linear actuator, which moves the lower pod section along a tubular guide sleeve between the full pod retraction and the full pod extension.

9. The nozzle of claim 8, further comprising one or more sensors and a central processing unit (CPU), wherein the CPU continuously or periodically activates the linear actuator to adjust the pod position, based upon one or more sensor readings.

10. The nozzle of claim 9, wherein the sensor readings comprise one or more of the following group: (i) flow velocity or velocity pressure of the exhaust gas at the nozzle discharge outlet, (ii) flow velocity or velocity pressure of the exhaust gas at the nozzle exhaust inlet, (iii) ambient cross-wind speed, and (iv) fan motor speed.

11. The nozzle of claim 5, wherein the upper effluent passageway has an annular convergence which is determined by the pod position, such that the annular convergence increases, and the upper effluent passageway narrows, as the impinger pod is adjusted from the full pod retraction to the full pod extension.

12. The nozzle of claim 11, wherein the pod position is adjustable by a linear actuator, which moves the lower pod section along a tubular guide sleeve between the full pod retraction and the full pod extension.

13. The nozzle of claim 12, further comprising one or more sensors and a central processing unit (CPU), wherein the CPU continuously or periodically activates the linear actuator to adjust the pod position, based upon one or more sensor readings.

14. The nozzle of claim 13, wherein the sensor readings comprise one or more of the following group: (i) flow velocity or velocity pressure of the exhaust gas at the nozzle discharge outlet, (ii) flow velocity or velocity pressure of the exhaust gas at the nozzle exhaust inlet, (iii) ambient cross-wind speed, and (iv) fan motor speed.

15. The nozzle according to any one of claims 1 through 10, further comprising a frusto-conical windband, which is attached in converging annular spaced relation to the nozzle wall, and which concentrically surrounds the nozzle discharge outlet, so as to define an upward-tapering frusto-conical windband exhaust passage, extending from a lower windband inlet opening to an upper windband outlet opening, such that a high velocity discharge of the exhaust gas from the nozzle discharge outlet induces an ambient air inflow upward through the windband exhaust passage.

* * * * *